US012742623B2

(12) United States Patent
Lucero et al.

(10) Patent No.: US 12,742,623 B2
(45) Date of Patent: Sep. 22, 2026

(54) ARTILLERY PROJECTILE WITH SEGMENTED BODY

(71) Applicant: Dynamic Systems and Research Corporation, Albuquerque, NM (US)

(72) Inventors: Joseph Lucero, Belen, NM (US); Danny J. Frew, Albuquerque, NM (US)

(73) Assignee: DYNAMIC SYSTEMS AND RESEARCH CORPORATION, Albuquerque, NM (US)

( * ) Notice: Subject to any disclaimer, the term of this patent is extended or adjusted under 35 U.S.C. 154(b) by 43 days.

(21) Appl. No.: 18/975,152

(22) Filed: Dec. 10, 2024

(65) Prior Publication Data

US 2026/0153315 A1 Jun. 4, 2026

Related U.S. Application Data

(60) Provisional application No. 63/609,232, filed on Dec. 12, 2023.

(51) Int. Cl.
*F42B 14/02* (2006.01)
*F42B 33/00* (2006.01)

(52) U.S. Cl.
CPC ..... *F42B 14/02* (2013.01); *F42B 33/001* (2013.01)

(58) Field of Classification Search
CPC ..... F42B 14/02; F42B 33/001
See application file for complete search history.

(56) References Cited

U.S. PATENT DOCUMENTS 165,255 A * 7/1875 Reilly ..... F42B 14/02 102/526

* cited by examiner

*Primary Examiner* — J. Woodrow Eldred
(74) *Attorney, Agent, or Firm* — Boisbrun Hofman, PLLC

(57) ABSTRACT

The present disclosure introduces an apparatus comprising an artillery projectile, the artillery projectile comprising: a body comprising external threads; and a band threaded to the external threads and configured to cooperate with an inner surface of a barrel of an artillery piece to thereby impart rotation to the artillery projectile during launch from the artillery piece.

20 Claims, 9 Drawing Sheets

ARTILLERY PROJECTILE WITH SEGMENTED BODY

CROSS-REFERENCE TO RELATED APPLICATIONS

This application claims priority to and the benefit of U.S. Provisional Application No. 63/609,232, titled "MULTI-PIECE ARTILLERY PROJECTILE," filed Dec. 12, 2023, the entire disclosure of which is hereby incorporated herein by reference.

BACKGROUND OF THE DISCLOSURE

Many artillery manufacturing processes are based on 50-year-old equipment that is specialized and unique. Recent military events around the world have resulted in the depletion of stockpiled artillery shells and the military establishment has learned that current industry capabilities with the manufacturing base is insufficient to keep up with the demand. With existing manufacturing facilities operating at more than traditional 100% capacities, world military agencies are actively researching other options to increase production rates.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus comprising an artillery projectile, the artillery projectile comprising: a body comprising external threads; and a band threaded to the external threads and configured to cooperate with an inner surface of a barrel of an artillery piece to thereby impart rotation to the artillery projectile during launch from the artillery piece.

The present disclosure also introduces a method of manufacturing an artillery projectile, comprising: threadedly engaging a band with first threads that extend around a periphery of one of first and second segments of a segmented body of the artillery projectile such that, during launch of the artillery projectile from a rifled barrel of an artillery piece, the band cooperates with an inner surface of the rifled barrel to thereby impart rotation to the artillery projectile; and forming a mechanical joint between the first and second segments by threadedly engaging second threads of the first segment with third threads of the second segment.

The present disclosure also introduces a method comprising determining at a first industrial facility that a plurality of like segmented bodies collectively differ in mass by no more than 1% (or perhaps less than 0.5%), wherein: (1) the segmented bodies are each intended for assembly in one of a plurality of artillery projectiles; (2) each segmented body comprises first and second segments, the first segment comprising a first open end for receiving a fuze and a second open end having second threads, and the second segment having third threads forming a mechanical joint with the second threads; and (3) the plurality of like segmented bodies comprises a plurality of first segmented bodies manufactured at a second industrial facility and a plurality of second segmented bodies manufactured at a third industrial facility.

The present disclosure also introduces an apparatus comprising: an artillery projectile for launching from an artillery piece; a centralizer formed by at least two sections collectively assembled around the artillery projectile; and a band threaded to external threads of the centralizer and configured to cooperate with an inner surface of a barrel of the artillery piece to thereby impart rotation to the centralizer, wherein the centralizer sections are collectively assembled around the artillery projectile in a manner sufficient to impart rotation of the band to the artillery projectile during launch.

The present disclosure also introduces an apparatus comprising a launch assembly that comprises: (1) an artillery projectile for launching from an artillery piece; and (2) one of: (a) a first band threaded to first external threads of a segmented body of the artillery projectile, wherein the first band is configured to cooperate with an inner surface of a barrel of an artillery piece to thereby impart rotation to the artillery projectile during launch from the artillery piece; and (b) a centralizer assembly comprising: (i) a centralizer formed by at least two sections collectively assembled around the artillery projectile; and (ii) a second band threaded to second external threads of the centralizer, wherein the second band is configured to cooperate with the artillery piece barrel inner surface to thereby impart rotation to the centralizer, and wherein the centralizer sections are collectively assembled around the artillery projectile in a manner sufficient to impart rotation of the second band to the artillery projectile during launch.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
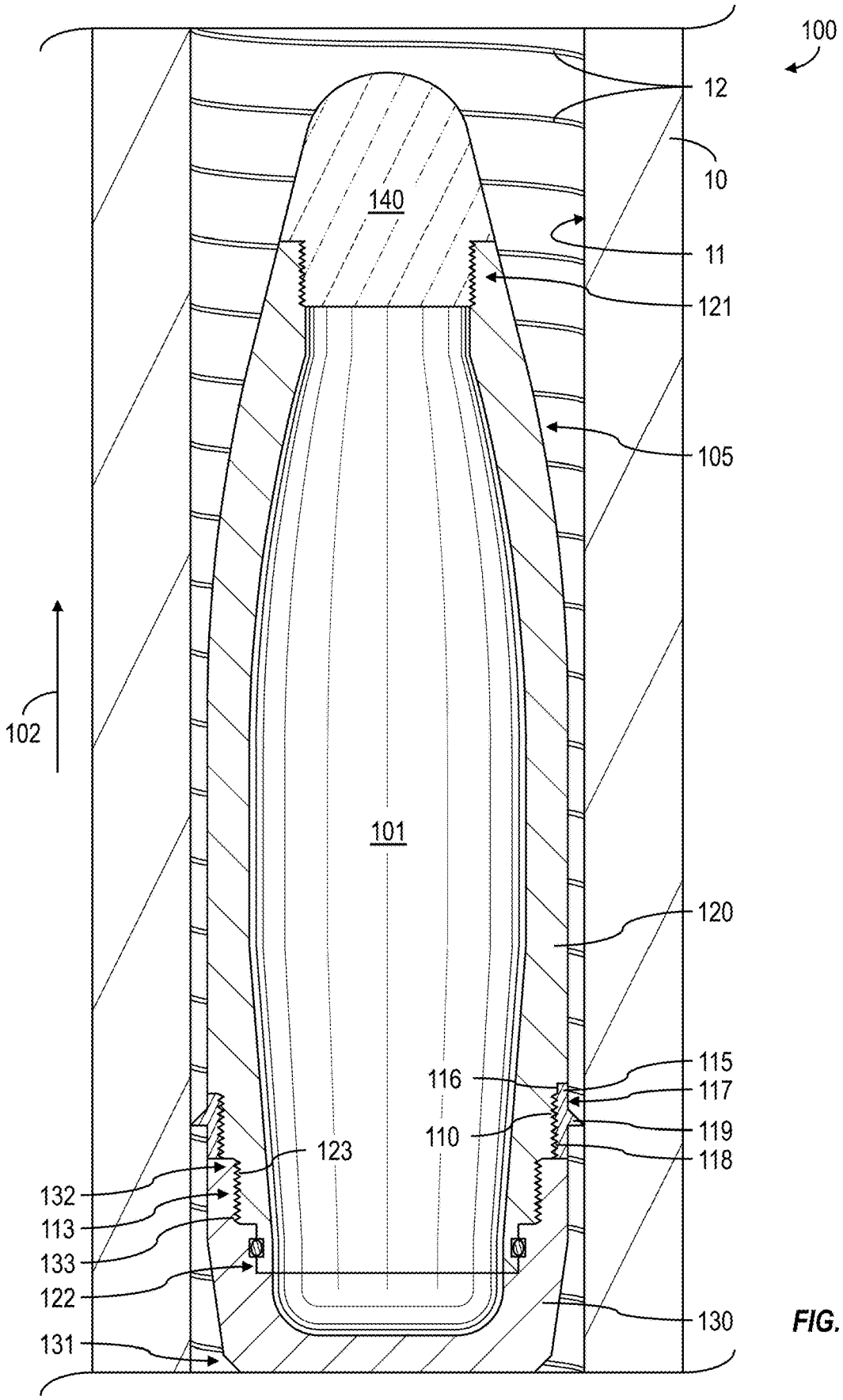
FIG. 1 is a sectional view of at least a portion of an example implementation of an artillery projectile according to one or more aspects introduced by the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure introduces apparatus for artillery applications. Each apparatus comprises a band configured to cooperate with an inner surface of a barrel of an artillery piece to thereby impart rotation to an artillery projectile being launched from the artillery piece. The band is threaded to either a body of the artillery projectile or a centralizer maintaining centering of the artillery projectile within the barrel. The present disclosure also introduces methods related to such artillery pieces, such as methods for manufacturing segmented projectile bodies that are currently difficult or impossible to produce using existing artillery manufacturing equipment.

The bodies of artillery projectiles introduced in the present disclosure are two-piece (i.e., segmented) bodies that can be drop-in replacements for existing MK64, M795, M107, M483A1, M692, M485A2, M825, and/or other unibody projectiles, as well as future-designed projectiles. The projectile bodies introduced herein can be fabricated utilizing currently available non-specialized manufacturing equipment, in contrast to the specialized manufacturing equipment currently required for existing unibody and/or other projectiles. The body segments introduced herein include threaded joints to reduce or eliminate forging-type procedures utilized for conventional unibody projectiles. In fact, the segmented body concepts of the present disclosure are applicable or readily adaptable for most (or perhaps any) artillery projectiles having wall thicknesses capable of accepting threads. Moreover, the swaging and/or welding procedures utilized to assemble rotating bands to conventional unibody and other projectiles (i.e., to impart rotation of the projectiles during launch) are replaced with a threaded rotating band concept that can be final machined before installation. Thus, the segmented projectile bodies of the present disclosure reduce or eliminate the requirement for unique furnaces, flow-forming, swaging presses/dies, welding, large hydraulic presses, and forging equipment, and instead utilizes industrial machining equipment that are common to current manufacturing facilities. Additionally, advanced high-pressure sealing mechanisms and joint mating surface designs support and control joint integrity during the ballistic pressure, spin, and acceleration environments in the gun barrel during launch. The seals and joint mating surfaces also provide internal pressure testing capability that supports acceptance testing requirements from the user.

Figure 2:
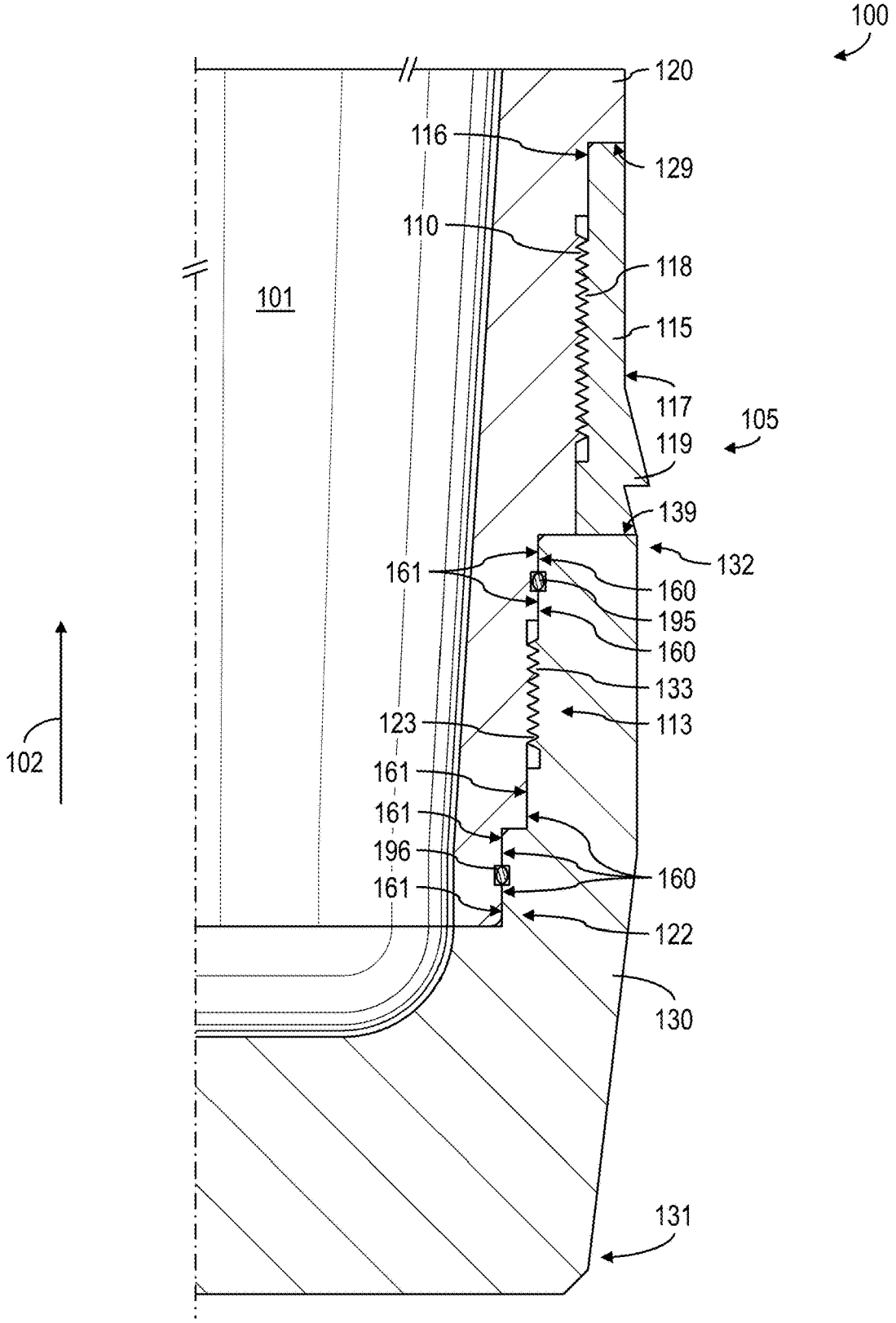
FIG. 2 is an enlarged portion of FIG. 1.

For example, FIG. 1 is a sectional view of a portion of an example implementation of a segmented artillery projectile (designated by reference number 100) according to one or more aspects introduced by the present disclosure. FIG. 2 is an enlarged view of a portion of FIG. 1. The following description refers to at least FIGS. 1 and 2, collectively.

The artillery projectile 100 is depicted in FIG. 1 as being positioned within an example implementation of an artillery piece barrel 10. The artillery projectile 100 comprises a body 105 having external threads 110, as well as a rotation band (or simply "band") 115 threaded to the external threads 110. The band 115 is configured to cooperate with an inner surface 11 of the artillery piece barrel 10 to thereby impart rotation to the artillery projectile 100 during launch from the artillery piece barrel 10.

The band 115 may be an annular metallic member comprising an internal surface 116 and an external surface 117. The internal surface 116 comprises internal threads 118 coupled with the external threads 110. The external surface 117 comprises at least one protrusion 119 that cooperates with rifling 12 in the inner surface 11 of the artillery piece barrel 10 to thereby impart the rotation. The external threads 110 and internal threads 118 may be left-hand threads to prevent unthreading of the band 115 from the artillery projectile 100 in response to clockwise rotation imparted to the artillery projectile that results from cooperation of the protrusion(s) 118 with the clockwise rifling 12. Alternatively, or additionally, a thread-locking compound, one or more set screw(s), and/or other means (none shown) may be utilized to prevent relative rotation of the band 115 and the body 105 during launch.

Unlike a traditionally manufactured one-piece, unibody artillery projectile, the body 105 comprises a first segment 120 and a second segment 130. The band 115 may (in lieu of the above-described thread-locking component set screw(s), and/or other locking means) be retained in its intended axial position via opposing shoulders 129, 139 of the segments 120, 130. In such implementations, the sequence of assembly of the segmented body 105 comprises threading the band 115 to the upper segment 120 before attaching the segments 120, 130 together. This concept is also applicable to other implementations within the scope of the present disclosure, including those implementations explicitly described below, even if the band being sandwiched between shoulders and/or other features of the segments is not explicitly described below.

The first and second segments 120, 130 can be manufactured from different materials depending upon application and performance requirements. Different materials for the band 115 can also be utilized compared to weldable and swage compliant materials in traditional projectile bodies.

As described above, the body 105 is a segmented body, such as comprising the forward and aft body segments 120, 130. The segments 120, 130 may at least partially define a payload chamber 101 for containing various types of incendiary and/or other materials, such as may be utilized in training and/or actual combat operations for asset destruction, battlefield illumination, and/or other uses also within the scope of the present disclosure. The forward segment 120 comprises an open end 121 for receiving a lifting ring plug and/or a fuze collectively depicted schematically in FIG. 1 by reference number 140. The fuze (e.g., at 140) may comprise a detonator (such as may trigger activation of the payload dependent upon contact, altitude, range traveled, elapsed time, etc.), a charge for expelling various materials (such as an illuminant and/or drogue/main parachute), and/or other fuzes also within the scope of the present disclosure. An opposite open end 122 of the forward segment 120 comprises threads 123. The aft segment 130 may substantially be a concave member having a closed end 131 and an open end 132 comprising threads 133. When the segmented body 105 is assembled, the threads 123, 133 form a mechanical joint 113 between the open ends 122, 132 of the body segments 120, 130, thereby coupling the segments 120, 130 together.

The threads 123, 133 may be left-hand threads to prevent unthreading of the segments 120, 130 during launch. Alternatively, or additionally, a thread-locking compound, one or more set screw(s), and/or other means (none shown) may be utilized to prevent relative rotation of the segments 120, 130 during launch.

In the example implementation depicted in FIG. 1: the forward segment 120 comprises the threads 110; the threads 123 are external threads; the threads 133 are internal threads; and the band 115 surrounds the segment 120 but not the segment 130. The preceding phrase, "the band 115 surrounds the segment 120 but not the segment 130," is intended to relate the axial position of the band 115 relative to the segments 120, 130 (rather than, for example, the respective radial dimensions and/or positioning of the band 115 and the segments 120, 130). In other words, the entirety of the band 115 is axially positioned forward of the segment 130 (relative to a direction of launch 102) and, thus, is also axially positioned forward of the mechanical joint 113 formed by the engaged threads 123, 133. However, in other implementations within the scope of the present disclosure, such as those in which the aft segment 130 comprises the threads 110 instead of the forward segment 120, the band 115 may instead surround the aft segment 130 but not the forward segment 120. In such implementations, among others also within the scope of the present disclosure: the threads 123 may instead be internal threads; and the threads 133 may instead be external threads. Moreover, as described below, the band 115 may also surround both segments 120, 130.

Figure 3:
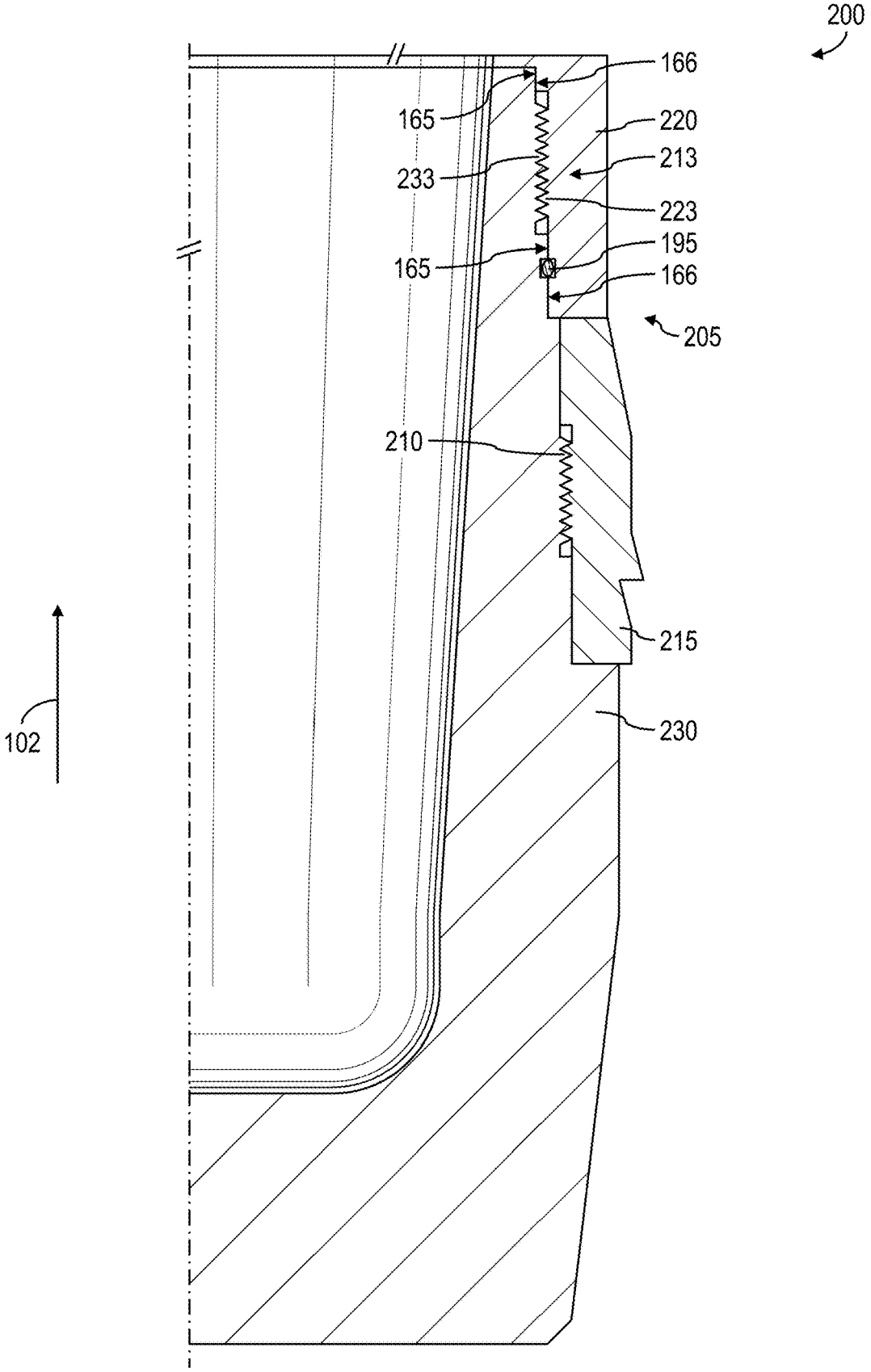
FIG. 3 is an enlarged portion of a sectional view of another example implementation of an artillery projectile according to one or more aspects introduced by the present disclosure.

For example, FIG. 3 is a sectional view of a portion of another example implementation of the artillery projectile shown in FIGS. 1 and 2, designated in FIG. 3 by reference number 200. The artillery projectile 200 of FIG. 3 is substantially the same or identical to the artillery projectile 100 of FIGS. 1 and 2, except as described below.

For example, the artillery projectile 200 comprises a body 205, an upper segment 220 with threads 223, an aft segment 230 with threads 233, and a band 215, each being analogous to the body 105, the upper segment 120, the threads 123, the aft segment 130, the threads 133, and the band 115 of the artillery projectile 100. However, while the forward segment 120 of the artillery projectile 100 comprises the threads 110 for coupling with the band 115, the aft segment 230 of the artillery projectile 200 comprises analogous threads 210 for coupling with the band 215. Consequently, the band 215 surrounds the aft segment 230 but not the forward segment 220. In other words, the entirety of the band 215 is axially positioned aft of the segment 220, including the engaged threads 223, 233.

An additional difference between the artillery projectiles 100, 200 is that the threads 223 of the forward segment 220 are internal threads and the threads 233 of the aft segment 230 are external threads, in contrast to the external threads 123 and internal threads 133. When the body 205 is assembled, the threads 223, 233 form a mechanical joint 213 axially positioned forward of the band 215.

The description above contemplates implementations in which one or more of the threads 110/123/133/210/223/233 may be left-hand threads. In those implementations (and similarly in other implementations also within the scope of the present disclosure), whether or not one or more of the 110/123/133/210/223/233 threads are left-hand threads may depend upon whether the band 115/215 is threaded to the forward segment 120/220 or to the aft segment 130/230. For example, if the band 115/215 is threaded onto the aft segment 130/230 in the forward-to-aft direction (i.e., opposite the launch direction 102, as in the implementation depicted in FIG. 3), then the threads 110/210 are left-hand threads so that the clockwise rotation of the band 115/215 (looking down barrel in the launch direction 102) won't loosen the band 115/215 from the aft segment 130/230 (especially absent any thread-locking material, set screw(s), and/or other locking means). However, the threads 123/133/223/233 between the forward and aft segments 120/220/130/230 may be right-hand threads so that the clockwise rotation of the aft segment 130/230 (imparted by the clockwise rotation of the band 115/215) won't loosen the aft segment 130/230 from the forward segment 120/220 (again, especially absent any locking means).

In contrast, if the band 115/215 is threaded onto the forward segment 120/220 in the aft-to-forward direction (i.e., the launch direction 102, as in the implementation depicted in FIG. 2), then the threads 110/210 are right-hand threads so that the clockwise rotation of the band 115/215 (looking down barrel in the launch direction 102) won't loosen the band 115/215 from the forward segment 120/220. However, the threads 123/133/223/233 between the forward and aft segments 120/220/130/230 may be left-hand threads so that the clockwise rotation of the forward segment 120/220 (imparted by the clockwise rotation of the band 115/215) won't loosen the forward segment 120/220 from the aft segment 130/230.

Figure 4:
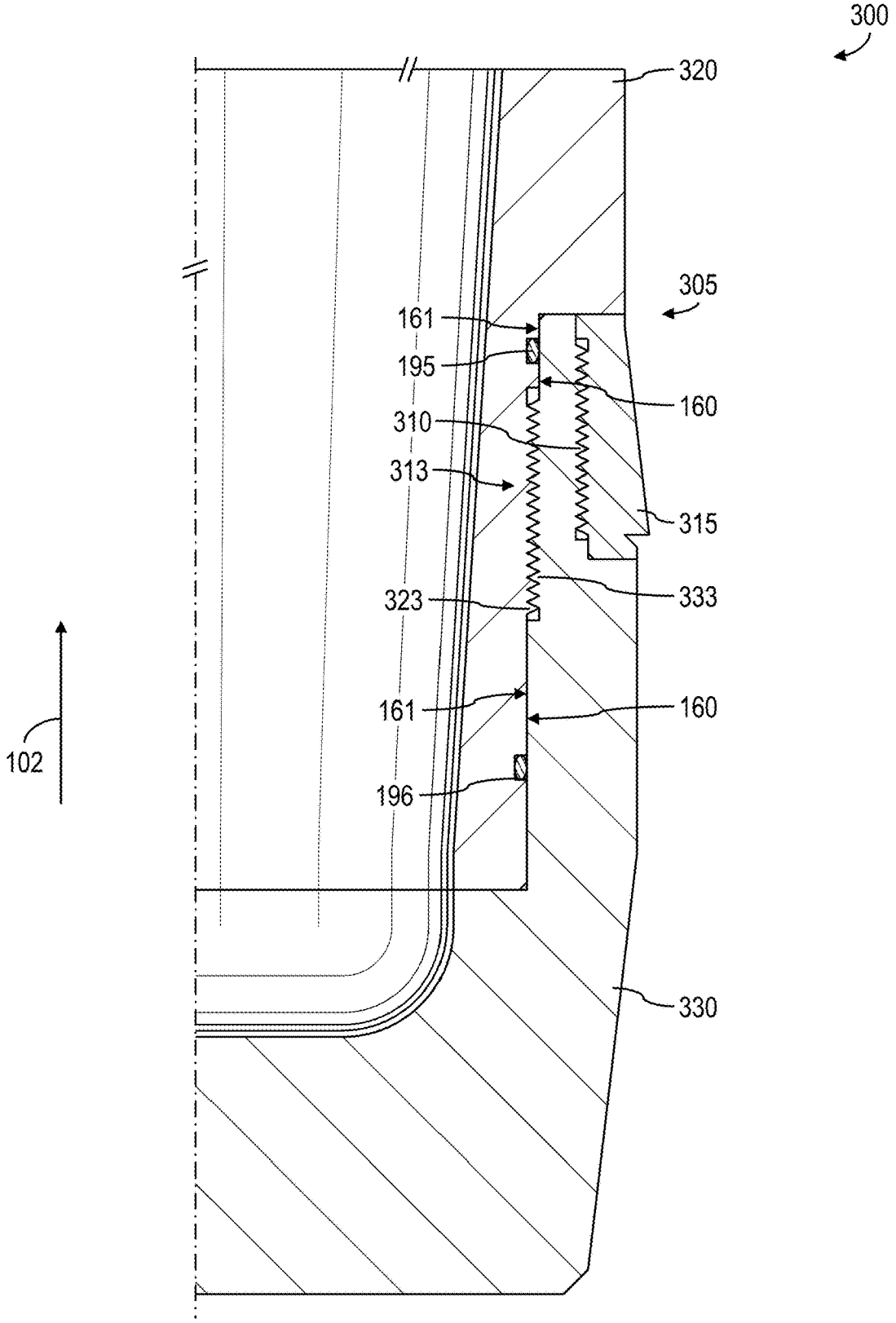
FIG. 4 is an enlarged portion of a sectional view of yet another example implementation of an artillery projectile according to one or more aspects introduced by the present disclosure.

FIG. 4 is a sectional view of a portion of another example implementation of the artillery projectiles shown in FIGS. 1 and 2, designated in FIG. 4 by reference number 300. The artillery projectile 300 of FIG. 4 is substantially the same or identical to the artillery projectile 100 of FIGS. 1 and 2, except as described below.

For example, the artillery projectile 300 comprises a body 305, a forward segment 320 with threads 323, an aft segment 330 with threads 333, and a band 315, each being analogous to the body 105, the segment 120, the threads 123, the segment 130, the threads 133, and the band 115 of the artillery projectile 100. However, while the forward segment 120 of the artillery projectile 100 comprises the threads 110 for coupling with the band 115, the aft segment 330 of the artillery projectile 300 comprises analogous threads 310 for coupling with the band 315. Moreover, the threads 310 (or at least a portion of the band 315) axially overlap the joint 313 formed by the threads 323, 333. Consequently, the band 315 surrounds both the forward segment 320 and the aft segment 330. In other words, the band 315 is positioned neither entirely forward of the aft segment 330 nor entirely aft of the forward segment 320.

FIGS. 1-4 also collectively demonstrate that the external profile of the band 115/215/315 can have differences in shape and/or dimensions (relative or absolute) in the myriad implementations within the scope of the present disclosure. Such variations, however, still permit cooperation between the external profile of the band 115/215/315 and the rifling 12 of the artillery piece barrel 10.

FIGS. 1-4 further depict how coupling the forward and aft segments 120/220/320, 130/230/330 via the corresponding threads 123/223/323, 133/233/333 may also create areal contact between non-threaded mating surfaces of the segments 120/220/320, 130/230/330. Such areal contact may increase a mechanical load path between the forward segments 120/220/320 and the aft segments 130/230/330, thus spreading axial, radial, torsional, and/or bending forces over a larger area and, thereby, rigidizing the body 105/205/305.

For example, as depicted in FIGS. 2 and 4, such non-threaded mating surfaces may include one or more outward-facing cylindrical surfaces 160 of the forward segment 120/320 that mate with one or more inward-facing cylindrical surfaces 161 of the aft segment 130/330. Similarly, as depicted in FIG. 3, the non-threaded mating surfaces may include one or more inward-facing cylindrical surfaces 165 of the forward segment 220 that mate with one or more outward-facing cylindrical surfaces 166 of the aft segment 230.

Figure 5:
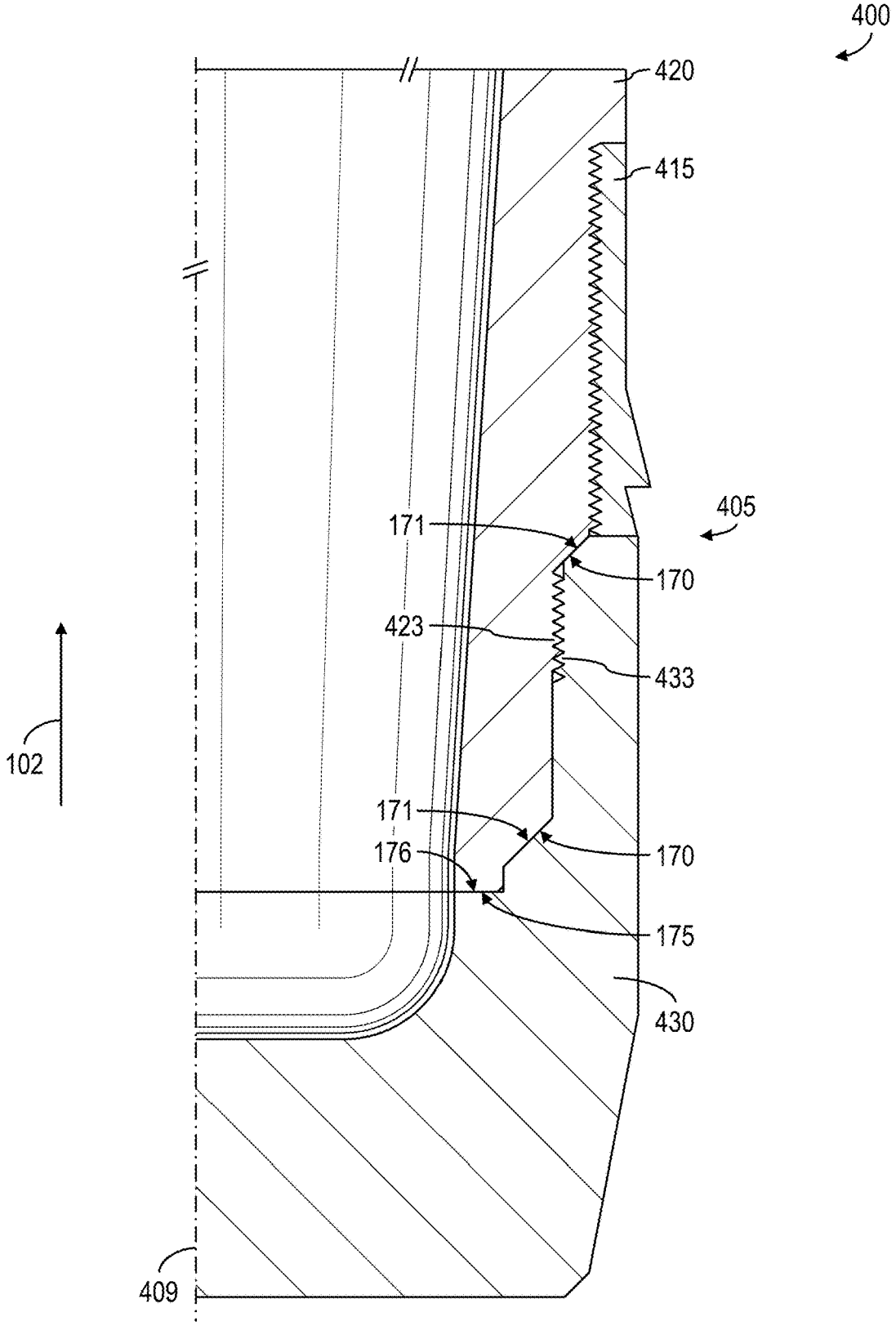
FIG. 5 is an enlarged portion of a sectional view of yet another example implementation of an artillery projectile according to one or more aspects introduced by the present disclosure.

FIG. 5 is a sectional view of a portion of another example implementation of the artillery projectiles shown in FIGS. 1 and 2, designated in FIG. 5 by reference number 400. The artillery projectile 400 of FIG. 5 is substantially the same or identical to the artillery projectile 100 of FIGS. 1 and 2, except as described below.

For example, the artillery projectile 400 comprises a body 405, a forward segment 420 with threads 423, an aft segment 430 with threads 433, and a band 415, each being analogous to the body 105, the segment 120, the threads 123, the segment 130, the threads 133, and the band 115 of the artillery projectile 100. The artillery projectile 400 demonstrates how the non-threaded mating surfaces may instead (or additionally) comprise one or more outward-facing non-cylindrical surfaces 170 of the forward segment 420 that mate with one or more inward-facing non-cylindrical surfaces 171 of the aft segment 430. For example, the non-cylindrical mating surfaces 170, 171 of the respective segments 420, 430 may each be frustoconical surfaces (e.g., chamfered at an angle relative to a longitudinal axis 409 of the segments 420, 430). The artillery projectile 400 also demonstrates how the non-threaded mating surfaces may instead (or additionally) comprise one or more aft-facing flat surfaces 175 of the forward segment 420 that mate with one or more forward-facing flat surfaces 176 of the aft segment 430.

Figure 6:
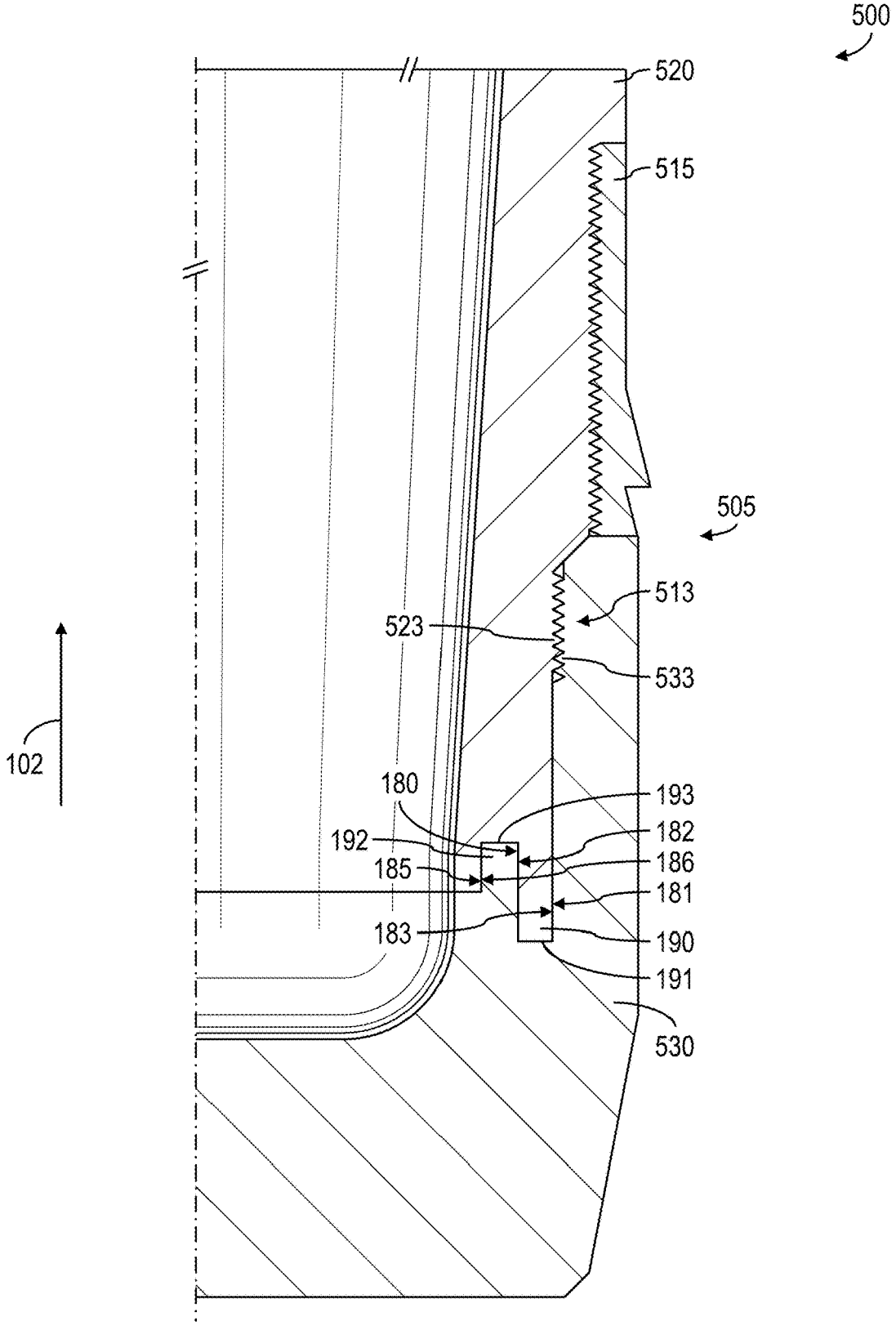
FIG. 6 is an enlarged portion of a sectional view of yet another example implementation of an artillery projectile according to one or more aspects introduced by the present disclosure.

FIG. 6 is a sectional view of a portion of another example implementation of the artillery projectile shown in FIG. 5, designated in FIG. 6 by reference number 500. The artillery projectile 500 of FIG. 6 is substantially the same or identical to the artillery projectile 400 of FIG. 5, except as described below.

For example, the artillery projectile 500 comprises a body 505, a forward segment 520 with threads 523, an aft segment 530 with threads 533, and a band 515, each being analogous to the body 405, the segment 420, the threads 423, the segment 430, the threads 433, and the band 415 of the artillery projectile 400. The artillery projectile 500 demonstrates how the non-threaded mating surfaces may instead (or additionally) comprise both of: one or more inward-facing cylindrical surfaces of the forward segment 520 that mate with one or more outward-facing cylindrical surfaces of the aft segment 530; and one or more outward-facing cylindrical surfaces of the forward segment 520 that mate with one or more inward-facing cylindrical surfaces of the after segment 530. For example, as depicted in FIG. 6, mating surfaces 180, 181 of the forward segment 520 may be cylindrical surfaces of an annular protrusion 190 extending from the forward segment 520 and mating with respective cylindrical surfaces 182, 183 of an annular recess 191 in the aft segment 530. Similarly, mating surfaces 182, 185 of the aft segment 530 may be cylindrical surfaces of an annular protrusion 192 extending from the aft segment 530 and mating with respective cylindrical surfaces 180, 186 of an annular recess 193 in the forward segment 520.

Implementations within the scope of the present disclosure may comprise various combinations of the above-described mating surfaces to further increase the rigidity and robustness of the artillery projectile body. For example, the mating surfaces may comprise a combination of: an inward-facing cylindrical surface of the forward segment mating with an outward-facing cylindrical surface of the aft segment; an outward-facing cylindrical surface of the forward segment mating with an inward-facing cylindrical surface of the aft segment; and an aft-facing flat surface of the forward segment mating with a forward-facing flat surface of the aft segment.

Another combination of mating surfaces may comprise: inner and outer cylindrical surfaces of a first annular protrusion extending from one of the segments and mating with respective inner and outer cylindrical surfaces of a first annular recess in the other segment such that the first annular protrusion is seated within the first annular recess; inner and outer cylindrical surfaces of a second annular protrusion extending from one of the segments and mating with respective inner and outer cylindrical surfaces of a second annular recess in the other segment such that the second annular protrusion is seated within the second annular recess; and an outward-facing non-cylindrical surface of the forward segment mating with an inward-facing non-cylindrical surface of the aft segment.

Another combination may comprise: inner and outer cylindrical surfaces of a first annular protrusion extending from one of the segments and mating with respective inner and outer cylindrical surfaces of a first annular recess in the other segment such that the first annular protrusion is seated within the first annular recess; inner and outer cylindrical surfaces of a second annular protrusion extending from one of the segments and mating with respective inner and outer cylindrical surfaces of a second annular recess in the other segment such that the second annular protrusion is seated within the second annular recess; an outward-facing cylindrical surface of the forward segment mating with an inward-facing cylindrical surface of the aft segment; and an outward-facing non-cylindrical surface of the forward segment mating with an inward-facing non-cylindrical surface of the aft segment.

In general, the mating surfaces may comprise a combination selected from the group consisting of:

- a first combination comprising an inward-facing cylindrical surface of the forward segment mating with an outward-facing cylindrical surface of the aft segment;
- a second combination comprising an outward-facing cylindrical surface of the forward segment mating with an inward-facing cylindrical surface of the aft segment;

a third combination comprising an outward-facing non-cylindrical surface of the forward segment mating with an inward-facing non-cylindrical surface of the aft segment;

a fourth combination comprising an inward-facing cylindrical surface of the forward segment mating with an outward-facing cylindrical surface of the aft segment, and an outward-facing cylindrical surface of the forward segment mating with an inward-facing cylindrical surface of the aft segment;

a fifth combination comprising an inward-facing cylindrical surface of the forward segment mating with an outward-facing cylindrical surface of the aft segment, an outward-facing cylindrical surface of the forward segment mating with an inward-facing cylindrical surface of the aft segment, and an aft-facing flat surface of the forward segment mating with a forward-facing flat surface of the aft segment;

a sixth combination comprising inner and outer cylindrical surfaces of an annular protrusion extending from one of the segments and mating with respective inner and outer cylindrical surfaces of an annular recess in the other segment such that the annular protrusion is seated within the annular recess;

a seventh combination comprising inner and outer cylindrical surfaces of a first annular protrusion extending from one of the segments and mating with respective inner and outer cylindrical surfaces of a first annular recess in the other segment such that the first annular protrusion is seated within the first annular recess, and inner and outer cylindrical surfaces of a second annular protrusion extending from one of the segments and mating with respective inner and outer cylindrical surfaces of a second annular recess in the other segment such that the second annular protrusion is seated within the second annular recess;

an eighth combination comprising inner and outer cylindrical surfaces of a first annular protrusion extending from one of the segments and mating with respective inner and outer cylindrical surfaces of a first annular recess in the other segment such that the first annular protrusion is seated within the first annular recess, inner and outer cylindrical surfaces of a second annular protrusion extending from one of the segments and mating with respective inner and outer cylindrical surfaces of a second annular recess in the other segment such that the second annular protrusion is seated within the second annular recess, and an outward-facing non-cylindrical surface of one of the segments mating with an inward-facing non-cylindrical surface of the other segment; and a ninth combination comprising inner and outer cylindrical surfaces of a first annular protrusion extending from one of the segments and mating with respective inner and outer cylindrical surfaces of a first annular recess in the other segment such that the first annular protrusion is seated within the first annular recess, inner and outer cylindrical surfaces of a second annular protrusion extending from one of the segments and mating with respective inner and outer cylindrical surfaces of a second annular recess in the other segment such that the second annular protrusion is seated within the second annular recess, an outward-facing cylindrical surface of the forward segment mating with an inward-facing cylindrical surface of the aft segment, and an outward-facing non-cylindrical surface of the forward segment mating with an inward-facing non-cylindrical surface of the other segment. The mating surfaces may comprise at least two different ones of the first-ninth combinations.

In some implementations, a surface finish of the above-described mating surfaces be not greater than 0.4 microns (μm) average roughness (Ra). However, other surface finishes are also within the scope of the present disclosure.

The above-described mechanical joints 113/213/313/413/513, pairs/combinations of mating surfaces, and even the minimized Ra of the mating surfaces combine to reduce or even eliminate bending and other destructive forces in the projectile body, thereby promoting joint design and reducing or even eliminating deflections that would be prevalent in conventional joint designs. Accordingly, the segmented body is not only more likely to survive launch from the artillery piece, but is also more likely to have better penetration performance at the target.

As also depicted in several of the figures described above, the segmented body 105/205/305/405/505 may comprise one or more sealing elements 195 between the forward and aft segments and/or on axially opposing sides of the mechanical joint 113/213/313/413/513. For example, the one or more sealing elements 195 may be elastomer O-rings and/or other means for ensuring a fluid (liquid and/or gas) seal between the forward and aft body segments, including across the mechanical joint formed by threading together the forward and aft body segments. Such sealing elements 195 may aid in preventing the passage of explosive materials and/or exhaust during launch, as well as during pressure testing of the segmented body 105/205/305/405/505 during the manufacturing process. Each sealing element 195 may be press-fit and/or otherwise received into a corresponding recess 196 in a mating surface of one or both of the body segments.

Figure 7:
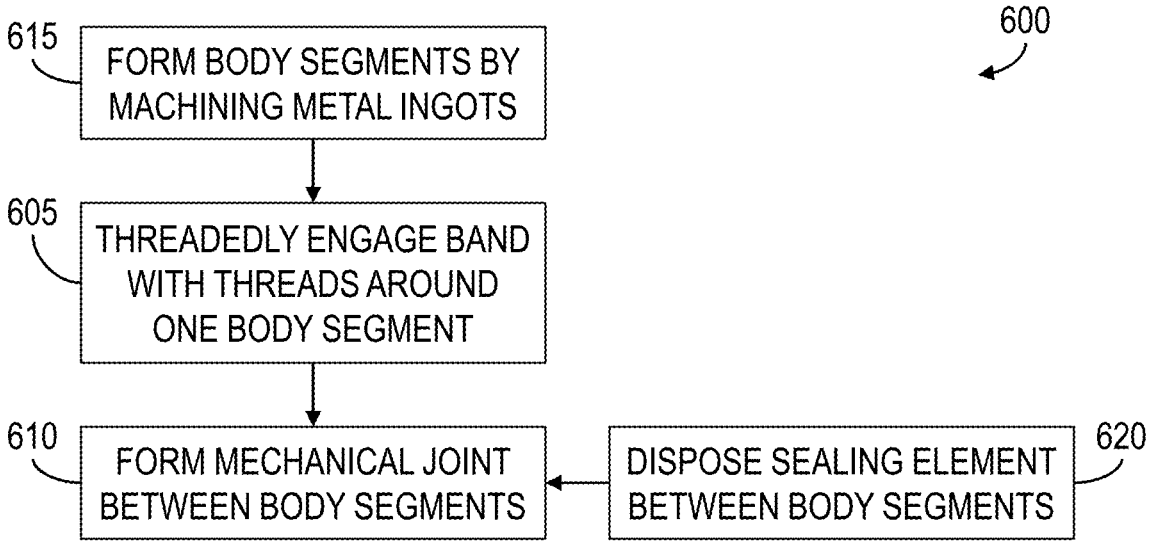
FIG. 7 is a flow-chart diagram of at least a portion of an example implementation of a method of manufacturing according to one or more aspects introduces by the present disclosure.

FIG. 7 is a flow-chart diagram of at least a portion of an example implementation of a method 600 of manufacturing an artillery projectile, such as one of the above-described projectiles, according to one or more aspects introduced by the present disclosure. The method 600 comprises threadedly engaging 605 a band with threads that extend around a periphery of one of first and second segments of a segmented body of the artillery projectile such that, during launch of the artillery projectile from a barrel of an artillery piece, the band cooperates with an inner surface of the barrel to thereby impart rotation to the artillery projectile. Threadedly engaging 605 the band with the threads may dispose the band in a final position in which the band surrounds the first segment but not the second segment, surrounds the second segment but not the first segment, or surrounds both of the first and second segments. The method 600 also comprises forming 610 a mechanical joint between the first and second segments by threadedly engaging threads of the first and segments. As an example, the band, first and second segments, body, artillery projectile, barrel, mechanical joint, and various second threads may respectively be the band 115, the forward segment 120, the aft segment 130, the body 105, the artillery projectile 100, the barrel 10, the mechanical joint 113, and corresponding threads depicted in FIG. 2.

Engaging 605 the band may occur before or after forming 610 the mechanical joint. The method 600 may also comprise, prior to engaging 605 the band and forming 610 the mechanical joint, forming 615 the first and second segments by machining respective first and second metal ingots, such as steel. Machining 615 one of the first and second ingots comprises forming the threads to which the band is engaged 605. Forming the first segment comprises forming a first open end for receiving a fuze and forming a second open end comprising the second threads, and forming the second segment comprises forming the third threads. Forming the first and second segments from the first and second ingots may not include forging or welding either of the first and second segments (although forming the first and second metal ingots, prior to forming the first and second segments from the ingots, likely does comprise forging). Machining the first and second ingots to form the first and second segments may comprise achieving a surface finish of the mating surfaces that is not greater than 0.4 μm Ra.

The method 600 may also comprise disposing 620 a sealing element between the first and second segments. For example, forming 610 the mechanical joint (by threading together the first and second segments) may retain the sealing element between the first and second segments. As described above, the sealing element may be an elastomeric O-ring received in a recess in a mating surface of one or both body segments.

Figure 8:
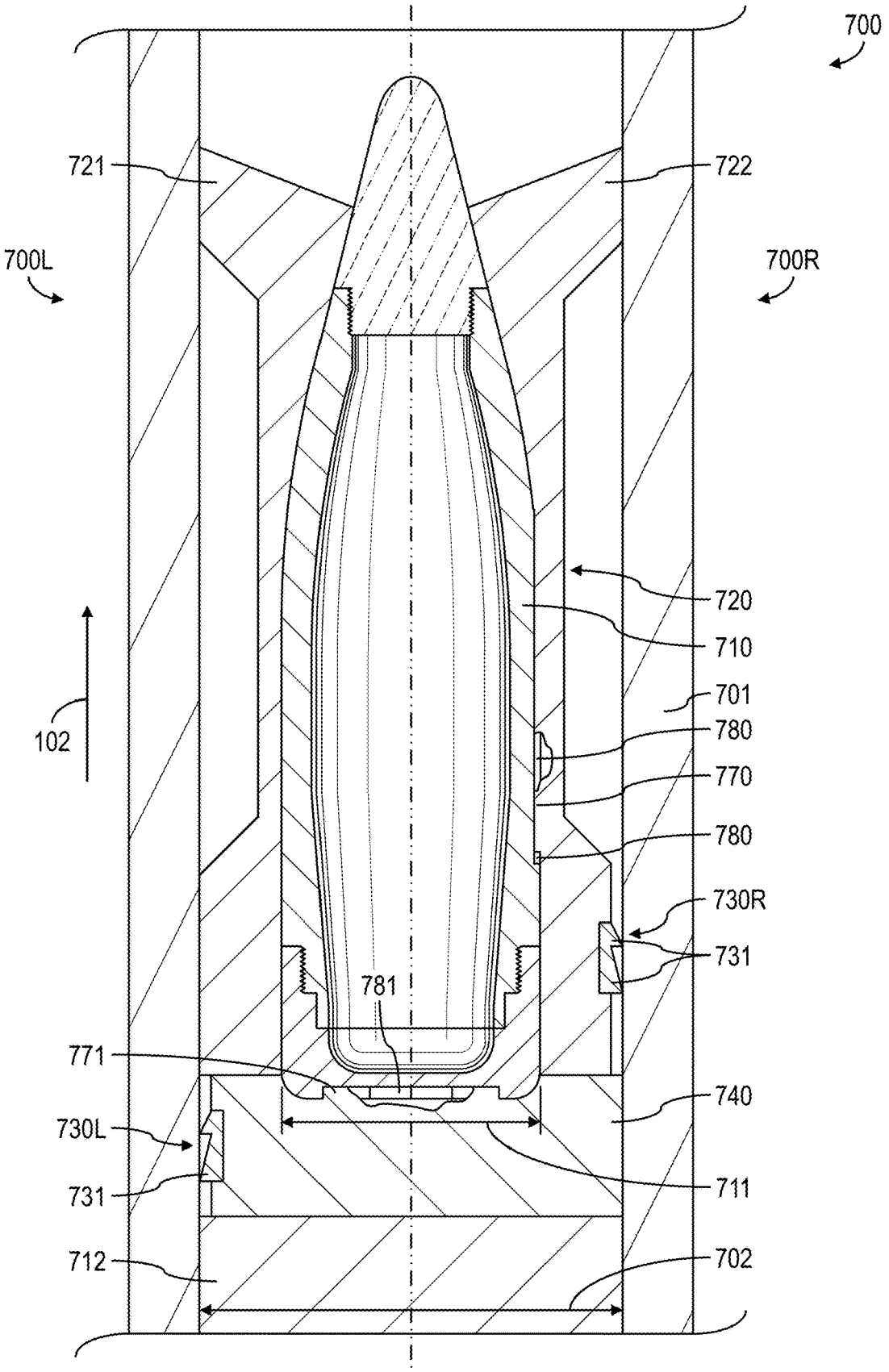
FIG. 8 is a sectional view of at least a portion of two, side-by-side example implementations of an artillery projectile launch package according to one or more aspects introduced by the present disclosure.

FIG. 8 is a sectional view of a portion of two, side-by-side example implementations of a launch assembly (also referred to herein as a "launch package") 700 each according to one or more aspects introduced by the present disclosure. The two implementations 700L and 700R are demarcated in FIG. 8 by a centerline 799 and are identical except as described below.

The launch package 700 comprises an artillery projectile 710 for launching from a barrel 701 of an artillery piece. Such projectile 710 has one or more aspects in common with one or more of the artillery projectiles 100, 200, 300, 400, 500 described above, although perhaps without the band 115, 215, 315, 415, 515. However, the artillery projectile 710 has an outer diameter 711 that is at least 10% smaller than an inner diameter 702 of the artillery piece barrel 701.

The launch package 700 also comprises a centralizer 720 formed by at least two sections 721, 722 collectively assembled around the artillery projectile 710. For example, the centralizer 720 may be a sabot, an external bore-rider, and/or other means for maintaining radial centering of the artillery projectile 710 within the barrel 701 during launch.

The launch package 700 may also comprise an obturator 740 to be positioned between the centralizer/projectile unit 720/710 and a breach 712 of the artillery piece. However, other means of similar purpose are also within the scope of the present disclosure.

The launch package 700 also comprises either a band 730L or a band 730R. The bands 730L/730R are each analogous to the above-described bands 115, 215, 315, 415, 515, except that the band 730L is threaded to external threads of the centralizer 720, and the band 730R is threaded to external threads of the obturator 740, instead of being threaded to external threads of the projectile 710. The bands 730L/730R are each configured to cooperate with the inner surface of the artillery piece barrel 701 to thereby impart rotation to the centralizer 720 (if the band 730R is extant) or the obturator (if the band 730L is extent).

The centralizer sections 721, 722 are collectively assembled around the artillery projectile 710 in a manner sufficient to permit (or even impart) rotation of the band 730 to the artillery projectile 710 during launch. For example, as depicted in implementation 700R, one or more elongated recesses 780 in the outer profile of the artillery projectile 710 may be configured to receive one or more spines 770 of one or both of the centralizer sections 721, 722 to thereby transfer rotation of the centralizer 720 to the projectile 710. Alternatively, as depicted in implementation 700L, a hexagonal or otherwise shaped recess 781 in the aft end of the artillery projectile 710 may be configured to receive a hexagonal or otherwise correspondingly shaped protrusion 771 of the obturator 740 to thereby transfer rotation of the obturator 740 to the centralizer/projectile unit 720/710.

Similar to as described above, the bands 730L/730R may be annular metallic members each comprising: an internal surface comprising internal threads coupled with the external threads of the centralizer 720 or obturator 740; and an external surface comprising at least one protrusion 731 that cooperates with rifling of the artillery piece barrel 701 to thereby impart the rotation to the centralizer 720 or obturator 740. Similar to as above, the external threads of the centralizer 720 or obturator 740 may be left-hand threads and/or may be applied with a thread-locking material, one or more set screws, and/or other means preventing disengagement of the band 730L/730R from the centralizer 720/obturator 740 during launch.

A segmented projectile body according to one or more aspects introduced by the present disclosure is likely one of a plurality of like segmented bodies, each manufactured according to the same design. However, by implementing one or more aspects of the present disclosure, the plurality of like segmented bodies may differ in mass by no more than 1%, perhaps less than 0.5%. The plurality of like segmented bodies may also collectively differ in weight distribution by no more than 1% (or perhaps less than 0.5%), and/or in center of gravity by no more than 1% (or perhaps less than 0.5%) in any direction. Accordingly, the plurality of like segmented bodies may collectively differ in center of aerodynamic pressure by no more than 1% (or perhaps less than 0.5%) in any direction.

Figure 9:
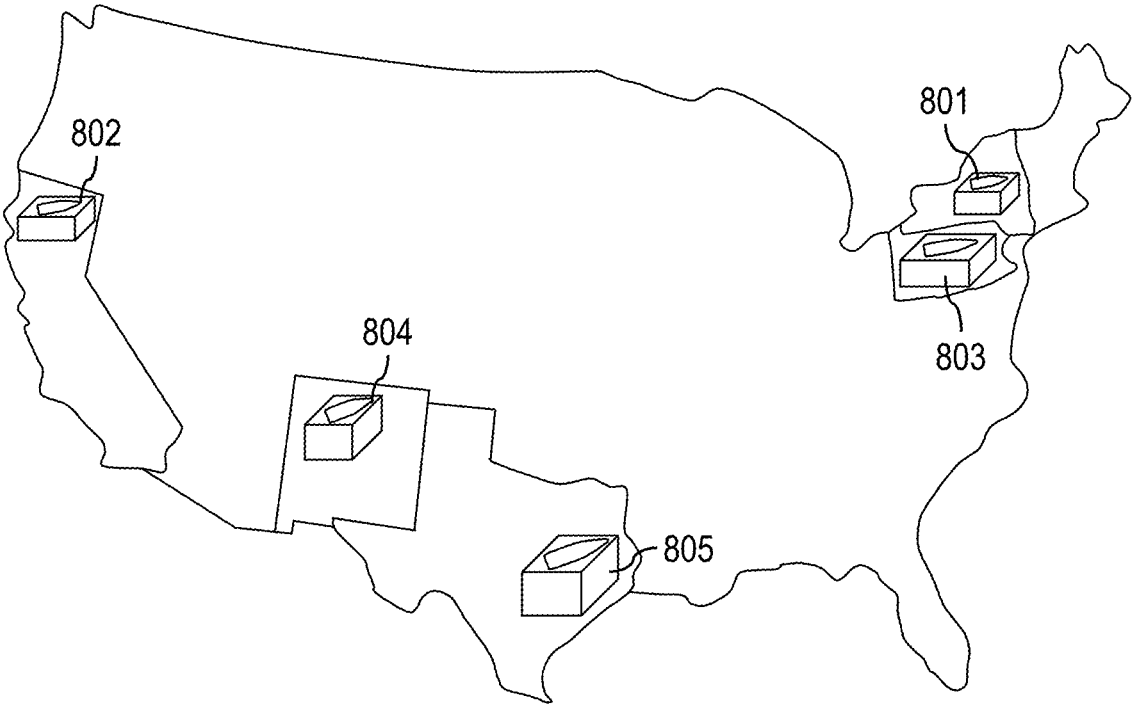
FIG. 9 is a schematic view of an example implementation of geographically and/or technically diverse manufacturing facilities according to one or more aspects introduced by the present disclosure.

FIG. 9 is a schematic view of geographically and/or technically diverse manufacturing facilities. The plurality of like segmented bodies may comprise a plurality of first segmented bodies that are manufactured at a first manufacturing facility 801 and a plurality of second segmented bodies that are manufactured at a second manufacturing facility 802, and perhaps additional segmented bodies that are manufactured at one or more other manufacturing facilities 803-805. For example, the first and second manufacturing facilities 801, 802 may be geographically separated by no less than 500 meters. However, by implementing one or more aspects introduced by the present disclosure, the segmented bodies may collectively still exhibit the above-described uniformity in mass, weight distribution, etc. despite being manufactured at facilities that are separated by hundreds of meters, or even thousands of kilometers. Such uniformity may also exist even when the different manufacturing facilities are owned and/or operated by different legal entities. Such reduced variations in physical characteristics may increase manufacturing yield, reduce manufacturing costs, and increasing targeting accuracy on the battlefield/training grounds, especially when comparing the segmented bodies of the present disclosure to those of conventional unibody designs.

The above-described geographic diversity of manufacturing facilities may mean the facilities are located in different regions of a country (e.g., the USA depicted in FIG. 9), and/or in different countries, such that each facility is subject to different circumstances and/or issues relative to the other facilities. Such differences may be in: (1) availability of raw materials and/or other supply chain factors, (2) personnel factors such as availability, skills, training, know-how, turnover, wages, vacation times/amounts, parental leave, loyalty, unions, organizations, apprenticeship practices, and/or workplace practices; and/or (3) other locale-specific factors such as workplace (e.g., safety) regulations and/or import/export limitations. The technical diversity of the different manufacturing facilities may include technical factors related to the above-described supply chain, personnel, and/or locale-specific factors. Nonetheless, artillery projectiles and/or launch packages manufactured by the collective facilities can conform to specifications that are more restrictive than existing specifications (e.g., with respect to dimensions, center of mass, center of aerodynamics, etc.) via implementation of one or more aspects introduced by the present disclosure, despite being collectively manufactured at geographically and/or technically diverse manufacturing facilities, including facilities of competing manufacturers. Thus, a greater number of manufacturers and/or manufacturing facilities can be utilized to increase cumulative production while maintaining physical uniformity conforming to the more restrictive specifications.

In view of the entirety of the present disclosure, including the claims and the figures, a person having ordinary skill in the art will recognize that the present disclosure introduces an apparatus comprising an artillery projectile, the artillery projectile comprising: a body comprising external threads; and a band threaded to the external threads and configured to cooperate with an inner surface of a barrel of an artillery piece to thereby impart rotation to the artillery projectile during launch from the artillery piece.

The band may be an annular metallic member comprising: an internal surface comprising internal threads coupled with the external threads; and an external surface comprising at least one protrusion that cooperates with rifling of the artillery piece barrel inner surface to thereby impart the rotation.

The external threads may be left-hand threads.

The external threads may be first threads; the body may be a segmented body at least partially defining a payload chamber; and the segmented body may comprise: a first segment comprising a first open end for receiving a fuze and a second open end having second threads; and a second segment having third threads forming a mechanical joint with the second threads. The second and third threads may be left-hand threads. The second segment may be a concave member comprising a closed end and an open end comprising the third threads.

The first segment may comprise the first threads. In such implementations, among others within the scope of the present disclosure, the second threads may be external threads and the third threads may be internal threads. For example, the band may surround the first segment but not the second segment, or the band may surround the first and second segments.

The second segment may comprise the first threads. In such implementations, among others within the scope of the present disclosure, the second threads may be internal threads and the third threads may be external threads. For example, the band may surround the second segment but not the first segment.

Areal contact between non-threaded mating surfaces of the first and second segments may partially form a mechanical load path between the first and second segments.

The mating surfaces may comprise an inward-facing cylindrical surface of the first segment mating with an outward-facing cylindrical surface of the second segment.

The mating surfaces may comprise an outward-facing cylindrical surface of the first segment mating with an inward-facing cylindrical surface of the second segment.

The mating surfaces may comprise an outward-facing non-cylindrical surface of the first segment mating with an inward-facing non-cylindrical surface of the second segment. The non-cylindrical mating surfaces of the first and second segments may each be chamfered at an angle relative to a longitudinal axis of the first and second segments.

The mating surfaces may comprise: an inward-facing cylindrical surface of the first segment mating with an outward-facing cylindrical surface of the second segment; and an outward-facing cylindrical surface of the first segment mating with an inward-facing cylindrical surface of the second segment.

The mating surfaces may comprise: an inward-facing cylindrical surface of the first segment mating with an outward-facing cylindrical surface of the second segment; an outward-facing cylindrical surface of the first segment mating with an inward-facing cylindrical surface of the second segment; and an aft-facing flat surface of the first segment mating with a forward-facing flat surface of the second segment.

The mating surfaces may comprise inner and outer cylindrical surfaces of an annular protrusion extending from the first segment and mating with respective inner and outer cylindrical surfaces of an annular recess in the second segment such that the annular protrusion of the first segment is seated within the annular recess of the second segment.

The mating surfaces may comprise inner and outer cylindrical surfaces of an annular protrusion extending from the second segment and mating with respective inner and outer cylindrical surfaces of an annular recess in the first segment such that the annular protrusion of the second segment is seated within the annular recess of the first segment.

The mating surfaces may comprise: inner and outer cylindrical surfaces of a first annular protrusion extending from the first segment and mating with respective inner and outer cylindrical surfaces of a first annular recess in the second segment such that the first annular protrusion of the first segment is seated within the first annular recess of the second segment; and inner and outer cylindrical surfaces of a second annular protrusion extending from the first segment and mating with respective inner and outer cylindrical surfaces of a second annular recess in the second segment such that the second annular protrusion of the first segment is seated within the second annular recess of the second segment.

The mating surfaces may comprise: inner and outer cylindrical surfaces of a first annular protrusion extending from the first segment and mating with respective inner and outer cylindrical surfaces of a first annular recess in the second segment such that the first annular protrusion of the first segment is seated within the first annular recess of the second segment; inner and outer cylindrical surfaces of a second annular protrusion extending from the first segment and mating with respective inner and outer cylindrical surfaces of a second annular recess in the second segment such that the second annular protrusion of the first segment is seated within the second annular recess of the second segment; and an outward-facing non-cylindrical surface of the first segment mating with an inward-facing non-cylindrical surface of the second segment.

The mating surfaces may comprise: inner and outer cylindrical surfaces of a first annular protrusion extending from the first segment and mating with respective inner and outer cylindrical surfaces of a first annular recess in the second segment such that the first annular protrusion of the first segment is seated within the first annular recess of the second segment; inner and outer cylindrical surfaces of a second annular protrusion extending from the first segment and mating with respective inner and outer cylindrical surfaces of a second annular recess in the second segment such that the second annular protrusion of the first segment is seated within the second annular recess of the second segment; an outward-facing cylindrical surface of the first segment mating with an inward-facing cylindrical surface of the second segment; and an outward-facing non-cylindrical surface of the first segment mating with an inward-facing non-cylindrical surface of the second segment.

The mating surfaces may comprise a combination selected from the group consisting of: (1) a first combination comprising an inward-facing cylindrical surface of the first segment mating with an outward-facing cylindrical surface of the second segment; (2) a second combination comprising an outward-facing cylindrical surface of the first segment mating with an inward-facing cylindrical surface of the second segment; (3) a third combination comprising an outward-facing non-cylindrical surface of the first segment mating with an inward-facing non-cylindrical surface of the second segment; (4) a fourth combination comprising (a) an inward-facing cylindrical surface of the first segment mating with an outward-facing cylindrical surface of the second segment, and (b) an outward-facing cylindrical surface of the first segment mating with an inward-facing cylindrical surface of the second segment; (5) a fifth combination comprising (a) an inward-facing cylindrical surface of the first segment mating with an outward-facing cylindrical surface of the second segment, (b) an outward-facing cylindrical surface of the first segment mating with an inward-facing cylindrical surface of the second segment, (c) and an aft-facing flat surface of the first segment mating with a forward-facing flat surface of the second segment; (6) a sixth combination comprising inner and outer cylindrical surfaces of an annular protrusion extending from the first segment and mating with respective inner and outer cylindrical surfaces of an annular recess in the second segment such that the annular protrusion of the first segment is seated within the annular recess of the second segment; (7) a seventh combination comprising inner and outer cylindrical surfaces of an annular protrusion extending from the second segment and mating with respective inner and outer cylindrical surfaces of an annular recess in the first segment such that the annular protrusion of the second segment is seated within the annular recess of the first segment; (8) an eighth combination comprising (a) inner and outer cylindrical surfaces of a first annular protrusion extending from the first segment and mating with respective inner and outer cylindrical surfaces of a first annular recess in the second segment such that the first annular protrusion of the first segment is seated within the first annular recess of the second segment, and (b) inner and outer cylindrical surfaces of a second annular protrusion extending from the first segment and mating with respective inner and outer cylindrical surfaces of a second annular recess in the second segment such that the second annular protrusion of the first segment is seated within the second annular recess of the second segment; (9) a ninth combination comprising (a) inner and outer cylindrical surfaces of a first annular protrusion extending from the first segment and mating with respective inner and outer cylindrical surfaces of a first annular recess in the second segment such that the first annular protrusion of the first segment is seated within the first annular recess of the second segment, (b) inner and outer cylindrical surfaces of a second annular protrusion extending from the first segment and mating with respective inner and outer cylindrical surfaces of a second annular recess in the second segment such that the second annular protrusion of the first segment is seated within the second annular recess of the second segment, and (c) an outward-facing non-cylindrical surface of the first segment mating with an inward-facing non-cylindrical surface of the second segment; and (10) a tenth combination comprising (a) inner and outer cylindrical surfaces of a first annular protrusion extending from the first segment and mating with respective inner and outer cylindrical surfaces of a first annular recess in the second segment such that the first annular protrusion of the first segment is seated within the first annular recess of the second segment, (b) inner and outer cylindrical surfaces of a second annular protrusion extending from the first segment and mating with respective inner and outer cylindrical surfaces of a second annular recess in the second segment such that the second annular protrusion of the first segment is seated within the second annular recess of the second segment, (c) an outward-facing cylindrical surface of the first segment mating with an inward-facing cylindrical surface of the second segment, and (d) an outward-facing non-cylindrical surface of the first segment mating with an inward-facing non-cylindrical surface of the second segment. The mating surfaces may comprise at least two different ones of the first-tenth combinations.

A surface finish of the mating surfaces may not be greater than 0.4 μm Ra.

The segmented body may comprise a sealing element between the first and second segments. The sealing element may be an O-ring.

The segmented body may be one of a plurality of like segmented bodies that collectively differ in mass by no more than 1% (or perhaps less than 0.5%). The like segmented bodies may collectively differ in weight distribution by no more than 1% (or perhaps less than 0.5%). The like segmented bodies may collectively differ in center of gravity by no more than 1% (or perhaps less than 0.5%) in any direction. The like segmented bodies may collectively differ in center of aerodynamic pressure by no more than 1% (or perhaps less than 0.5%) in any direction.

The like segmented bodies may comprise: a plurality of first segmented bodies manufactured at a first manufacturing facility; and a plurality of second segmented bodies manufactured at a second manufacturing facility. The first and second manufacturing facilities may be geographically separated by no less than 500 meters. The first and second manufacturing facilities may be owned and/or operated by different legal entities.

The present disclosure also introduces a method of manufacturing an artillery projectile, comprising: threadedly engaging a band with first threads that extend around a periphery of one of first and second segments of a segmented body of the artillery projectile such that, during launch of the artillery projectile from a barrel of an artillery piece, the band cooperates with an inner surface of the barrel to thereby impart rotation to the artillery projectile; and forming a mechanical joint between the first and second segments by threadedly engaging second threads of the first segment with third threads of the second segment.

The method may comprise: forming the first segment by machining a first metal ingot; and forming the second segment by machining a second metal ingot. Machining one of the first and second metal ingots may comprise forming the first threads extending around a periphery of one of the first and second segments. Forming the first segment may comprise: forming a first open end for receiving a fuze; and forming a second open end comprising the second threads. Forming the second segment may comprise forming the third threads. The second and third threads may be left-hand threads.

The second segment may be formed as a concave member comprising: a closed end; and an open end comprising the third threads.

Forming the first segment may comprise forming the first threads extending around the periphery of the first segment. In such implementations, among others within the scope of the present disclosure, the second threads may be external threads and the third threads may be internal threads. Threadedly engaging the band with the first threads may dispose the band in a final position surrounding the first segment but not the second segment. Threadedly engaging the band with the first threads may dispose the band in a final position surrounding the first and second segments.

Forming the second segment may comprise forming the first threads extending around the periphery of the second segment. The second threads may be internal threads and the third threads may be external threads.

The band may surround the second segment but not the first segment.

Forming the first and second segments from the first and second ingots may not include forging and/or welding either of the first and second segments.

Forming the mechanical joint by threadedly engaging the second and third threads may comprise establishing areal contact between non-threaded mating surfaces of the first and second segments, wherein the areal contact between the mating surfaces of the first and second segments may partially form a mechanical load path between the first and second segments. Machining the first and second ingots to form the first and second segments may comprise achieving a surface finish of the mating surfaces that is not greater than 0.4 μm Ra.

The method may comprise disposing a sealing element between the first and second segments, wherein forming the mechanical joint may retain the sealing element between the first and second segments. The sealing element may be an O-ring.

The present disclosure also introduces a method comprising determining at a first industrial facility that a plurality of like segmented bodies collectively differ in mass by no more than 1% (or perhaps less than 0.5%), wherein: (1) the segmented bodies are each intended for assembly in one of a plurality of artillery projectiles; (2) each segmented body comprises first and second segments, the first segment comprising a first open end for receiving a fuze and a second open end having second threads, and the second segment having third threads forming a mechanical joint with the second threads; and (3) the plurality of like segmented bodies comprises a plurality of first segmented bodies manufactured at a second industrial facility and a plurality of second segmented bodies manufactured at a third industrial facility.

The method may comprise determining at the first industrial facility that the plurality of like segmented bodies collectively differ in weight distribution by no more than 1% (or less than 0.5%).

The method may comprise determining at the first industrial facility that the plurality of like segmented bodies collectively differ in center of gravity by no more than 1% (or less than 0.5%) in any direction.

The method may comprise determining at the first industrial facility that the plurality of like segmented bodies collectively differ in center of aerodynamic pressure by no more than 1% (or less than 0.5%) in any direction.

The second and third manufacturing facilities may be geographically separated by no less than 500 meters and/or owned and/or operated by different legal entities.

The present disclosure also introduces an apparatus comprising: an artillery projectile for launching from an artillery piece; a centralizer formed by at least two sections collectively assembled around the artillery projectile; and a band threaded to external threads of the centralizer and configured to cooperate with an inner surface of a barrel of the artillery piece to thereby impart rotation to the centralizer, wherein the centralizer sections are collectively assembled around the artillery projectile in a manner sufficient to impart rotation of the band to the artillery projectile during launch.

The band may be an annular metallic member comprising: an internal surface comprising internal threads coupled with the external threads; and an external surface comprising at least one protrusion that cooperates with rifling of the artillery piece barrel inner surface to thereby impart the rotation to the centralizer.

The external threads may be left-hand threads.

The external threads may be first threads; the artillery projectile may comprise a segmented body at least partially defining a payload chamber; and the segmented body may comprise first and second segments, the first segment comprising a first open end for receiving a fuze and a second open end having second threads, and the second segment having third threads forming a mechanical joint with the second threads. The second and third threads may be left-hand threads. The second segment may be a concave member comprising a closed end and an open end comprising the third threads.

The second threads may be external threads and the third threads may be internal threads.

The second threads may be internal threads and the third threads may be external threads.

The band may be axially positioned, relative to the artillery projectile, to extend around a portion of the first segment but not the second segment, to extend around a portion of the second segment but not the first segment, or to extend around portions of both the first and second segments.

Areal contact between non-threaded mating surfaces of the first and second segments may partially form a mechanical load path between the first and second segments. The mating surfaces may be as described above, including in the above-described combinations.

The segmented body may comprise a sealing element between the first and second segments. The sealing element may be an O-ring.

The present disclosure also introduces an apparatus comprising a launch assembly that comprises: (1) an artillery projectile for launching from an artillery piece; and (2) one of: (a) a first band threaded to first external threads of a segmented body of the artillery projectile, wherein the first band is configured to cooperate with an inner surface of a barrel of an artillery piece to thereby impart rotation to the artillery projectile during launch from the artillery piece; and (b) a centralizer assembly comprising: (i) a centralizer formed by at least two sections collectively assembled around the artillery projectile; and (ii) a second band threaded to second external threads of the centralizer, wherein the second band is configured to cooperate with the artillery piece barrel inner surface to thereby impart rotation to the centralizer, and wherein the centralizer sections are collectively assembled around the artillery projectile in a manner sufficient to impart rotation of the second band to the artillery projectile during launch.

Each of the first and second bands may be an annular metallic member comprising: an internal surface comprising internal threads coupled with the corresponding first and second external threads; and an external surface comprising at least one protrusion that cooperates with rifling of the artillery piece barrel inner surface to thereby impart the rotation.

The first and second external threads may be left-hand threads.

The segmented body may comprise first and second segments, the first segment comprising a first open end for receiving a fuze and a second open end having third threads, the second segment having fourth threads forming a mechanical joint with the third threads. The third and fourth threads may be left-hand threads. The second segment may be a concave member comprising a closed end and an open end comprising the fourth threads.

The launch assembly may comprise the first band, the third threads may be external threads, and the fourth threads may be internal threads.

The launch assembly may comprise the first band and the first band may surround: the first segment but not the second segment; or the first and second segments.

The launch assembly may comprise the second band, the third threads may be internal threads, and the fourth threads may be external threads.

The launch assembly may comprise the second band, and the band may surround the second segment but not the first segment.

Areal contact between non-threaded mating surfaces of the first and second segments may partially form a mechanical load path between the first and second segments. The mating surfaces may be as described above, including in the above-described combinations. A surface finish of the mating surfaces may not be greater than 0.4 μm Ra.

The segmented body may comprise a sealing element between the first and second segments. The sealing element may be an O-ring.

The segmented body may be one of a plurality of like segmented bodies that collectively differ in mass by no more than 1% (or perhaps lower than 0.5%). The like segmented bodies may collectively differ in weight distribution by no more than 1% (or perhaps less than 0.5%). The like segmented bodies may collectively differ in center of gravity by no more than 1% (or perhaps less than 0.5%) in any direction. The like segmented bodies may collectively differ in center of aerodynamic pressure by no more than 1% (or perhaps less than 0.5%) in any direction.

The like segmented bodies may comprise: a plurality of first segmented bodies manufactured at a first manufacturing facility; and a plurality of second segmented bodies manufactured at a second manufacturing facility. The first and second manufacturing facilities may be geographically separated by no less than 500 meters. The first and second manufacturing facilities may be owned and/or operated by different legal entities.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus, comprising:
an artillery projectile comprising:
a segmented body at least partially defining a payload chamber and comprising external threads being first threads, said segmented body comprising:
a first segment with a first open end for receiving a fuze and a second open end having second threads, and
a second segment having third threads forming a mechanical joint with the second threads; and
a band threaded to the first threads and configured to cooperate with an inner surface of an artillery piece barrel to thereby impart rotation to the artillery projectile during launch from the artillery piece barrel.

2. The apparatus of claim 1 wherein the band is an annular metallic member comprising:
an internal surface comprising internal threads coupled with the first threads; and
an external surface comprising at least one protrusion that cooperates with rifling of the inner surface of the artillery piece barrel to thereby impart the rotation.

3. The apparatus of claim 1 further comprising a centralizer formed around the artillery projectile.

4. The apparatus of claim 1 wherein the second segment is a concave member comprising:
a closed end; and
an open end comprising the third threads.

5. The apparatus of claim 1 wherein:
the first segment comprises the first threads;
the second threads are external threads; and
the third threads are internal threads.

6. The apparatus of claim 1 wherein the band surrounds the first segment but not the second segment.

7. The apparatus of claim 1 wherein the band surrounds the first and second segments.

8. The apparatus of claim 1 wherein:
the second segment comprises the first threads;
the second threads are internal threads;
the third threads are external threads; and
the band surrounds the second segment but not the first segment.

9. The apparatus of claim 1 wherein areal contact between non-threaded mating surfaces of the first and second segments partially forms a mechanical load path between the first and second segments.

10. The apparatus of claim 9 wherein the non-threaded mating surfaces comprise an outward-facing cylindrical surface of the first segment mating with an inward-facing cylindrical surface of the second segment.

11. The apparatus of claim 1 wherein the segmented body further comprises a sealing element between the first and second segments.

12. The apparatus of claim 1 wherein the segmented body is one of a plurality of like segmented bodies that collectively differ in mass by no more than one percent.

13. A method of manufacturing an artillery projectile, comprising:
threadedly engaging a band with first threads that extend around a periphery of one of first and second segments of a segmented body of the artillery projectile such that, during launch of the artillery projectile from an artillery piece barrel, the band cooperates with an inner surface of the artillery piece barrel to thereby impart rotation to the artillery projectile; and forming a mechanical joint between the first and second segments by threadedly engaging second threads of the first segment with third threads of the second segment.

14. The method of claim 13 further comprising:

forming the first segment by machining a first metal ingot; and forming the second segment by machining a second metal ingot.

15. The method of claim 14 wherein:

machining one of the first and second metal ingots comprises forming the first threads extending around the periphery of one of the first and second segments;

forming the first segment comprises:

forming a first open end for receiving a fuze; and forming a second open end comprising the second threads; and forming the second segment comprises forming the third threads.

16. The method of claim 13 wherein:

forming the first segment comprises forming the first threads extending around the periphery of the first segment;

the second threads are external threads;

the third threads are internal threads; and threadedly engaging the band with the first threads disposes the band in a final position surrounding the first segment but not the second segment.

17. The method of claim 13 wherein:

forming the first segment comprises forming the first threads extending around the periphery of the first segment;

the second threads are external threads;

the third threads are internal threads; and threadedly engaging the band with the first threads disposes the band in a final position surrounding the first and second segments.

18. The method of claim 13 wherein:

forming the second segment comprises forming the first threads extending around the periphery of the second segment;

the second threads are internal threads;

the third threads are external threads; and the band surrounds the second segment but not the first segment.

19. The method of claim 14 wherein forming the first and second segments from the first and second metal ingots does not include forging or welding either of the first and second segments.

20. The method of claim 13 wherein:

forming the mechanical joint by threadedly engaging the second and third threads comprises establishing areal contact between non-threaded mating surfaces of the first and second segments;

the areal contact between the non-threaded mating surfaces of the first and second segments partially forms a mechanical load path between the first and second segments;

the method further comprises disposing a sealing element between the first and second segments; and forming the mechanical joint retains the sealing element between the first and second segments.

* * * * *